US006100649A

United States Patent [19]

Shoshan et al.

[11] Patent Number: 6,100,649

[45] Date of Patent: Aug. 8, 2000

[54] CIRCUIT ARRANGEMENT FOR IGNITING GAS DISCHARGE FLASH TUBES

[75] Inventors: Itamar Shoshan, Yahud; Gad Rawnitzki, Moshav Beit Oved; Alexander Zak, Ashkelon; Shlomo Gilead, Rehovot, all of Israel

[73] Assignee: Elop Electro Optics Industries, Inc., Rehovot, Israel

[21] Appl. No.: 09/156,670

[22] Filed: Sep. 18, 1998

[30] Foreign Application Priority Data

Sep. 22, 1997 [IL] Israel ..... 121819

[51] Int. Cl.[7] ..... H05B 37/00

[52] U.S. Cl. ..... 315/244; 315/289; 315/291; 315/200 A; 315/307

[58] Field of Search ..... 315/244, 240, 315/241 R, 242, 193, 187, 188, 189, 283, 284, 289, 291, 200 A, 307, DIG. 5

[56] References Cited

U.S. PATENT DOCUMENTS

| | | | |
|---|---|---|---|
| 3,912,968 | 10/1975 | Nakamura | 315/200 |
| 4,037,136 | 7/1977 | Hoene | 315/200 X |
| 4,070,601 | 1/1978 | Hoene | 315/241 R |
| 4,695,771 | 9/1987 | Hallay | 315/244 |
| 5,051,660 | 9/1991 | Domann et al. | 315/DIG. 7 |
| 5,367,227 | 11/1994 | Gademann et al. | 315/240 |

FOREIGN PATENT DOCUMENTS

| | | | |
|---|---|---|---|
| 0435228 A2 | 7/1991 | European Pat. Off. | H05B 41/29 |

*Primary Examiner*—Haissa Philogene
*Assistant Examiner*—Thuy Vinh Tran
*Attorney, Agent, or Firm*—Pollock Vande Sande & Amernick

[57] ABSTRACT

The invention provides a circuit arrangement for igniting gas discharge flash tubes including a gas discharge flash tube having two-spaced-apart electrodes, a pulse forming network and a voltage generator for supplying ignition pulses and tube burning pulses during simmer mode, the arrangement having a resonant circuit connected in circuit between the electrodes and the voltage generator, wherein the voltage generator provides the resonant circuit with AC high frequency voltage for producing gradually increasing amplitudes of an AC voltage until ignition voltage is achieved and for supplying AC voltage of a lower level in comparison to the level of the ignition voltage, for sustaining the burning of the tube during the simmer mode.

11 Claims, 2 Drawing Sheets

CIRCUIT ARRANGEMENT FOR IGNITING GAS DISCHARGE FLASH TUBES

BACKGROUND OF THE INVENTION

1. Field of the Invention

The present invention relates to a circuit arrangement for igniting gas discharge flash tubes, and more particularly to a circuit arrangement of the type having at least two main electrodes and connected in parallel with a pulse forming network which is constituted by a chargeable flash capacitor and discharge current limiting inductor.

2. Description of the Prior Art

U.S. Pat. No. 4,070,601 discloses a circuit arrangement for igniting at least one gas discharge flash tube having two main electrodes which are arranged in parallel with a chargeable flash capacitor and at least one electronic switch and are connected to a voltage generator which supplies ignition high frequency (HF) voltage pulses. The electronic switch, likewise, is constituted by at least one gas discharge vessel.

A circuit arrangement of the above type is characterized, in particular, in that the at least one additional gas discharge vessel, which is connected in the discharge circuit in series with the gas discharge flash tube, and which is designed for high forward currents, high blocking voltages and ignition HF voltage pulses of both polarities, can operate on the flash tube and on the at least one gas discharge vessel.

Ignition reliability of this arrangement depends on a statistical distribution of an average delay time of a breakthrough of all gas discharge vessels in the discharge circuit. Moreover, this arrangement simultaneously utilizes up to 5 gas discharge vessels, each of which has a specific level of breakthrough voltage.

In accordance with the teachings of said U.S. patent, the ignition generator has a low impedance, in particular a low inductance, so that the ignition pulses which it supplies, at least adiabatically, heat the gas discharge paths. The energy is supplied within a period of time such that the plasma filament is unable to return to the environment any part of the energy worthy of note, due to heat conduction and radiation losses. For instance, in order to obtain a channel having a resistance of 1 Ohm under normal flash conditions, the obtained channel must be supplied with a quantity of energy in the order of 1000 $\mu$W within an interval of time less than 1 $\mu$Sec.

SUMMARY OF THE INVENTION

It is therefore the object of the present invention to provide a circuit arrangement for igniting gas discharge flash tubes, in which tube ignition leads to a flash discharge without utilizing additional gas discharge vessels, and in which the ignition voltage amplitude excludes formation of arcs or corona conditions around the flash tube and excludes high blocking voltage requirements for the electronic switch in the discharge circuit and the necessity for preliminary charging of a flash capacitor.

According to the invention, the above object is achieved by providing a circuit arrangement for igniting gas discharge flash tubes including a gas discharge flash tube having two spaced-apart electrodes, a pulse forming network and a voltage generator for supplying ignition pulses and tube burning pulses during simmer mode, said arrangement comprising a resonant circuit connected in circuit between said electrodes and said voltage generator, wherein said voltage generator provides said resonant circuit with AC high frequency voltage for producing gradually increasing amplitudes of an AC voltage until ignition voltage is achieved and for supplying AC voltage of a lower level in comparison to the level of the ignition voltage, for sustaining the burning of said tube during said simmer mode.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIGS. 1–5 are circuit diagrams of various embodiments of circuit arrangements for igniting a gas discharge flash tube according to the invention; and FIG. 6 shows various voltage wave forms relating to two time periods during the operation of any of the circuits shown in FIGS. 1 to 5.

DETAILED DESCRIPTION OF PREFERRED EMBODIMENTS

Figure 1:
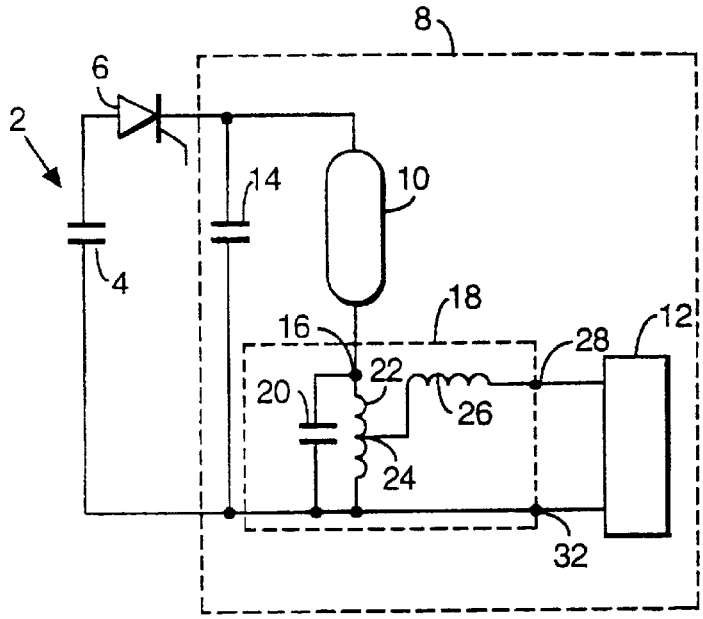

FIG. 1 is a circuit diagram schematically showing a pulse forming network 2, comprising flash capacitor 4, a power switch 6 and a circuit arrangement 8 for igniting a gas discharge flash tube 10 connected in series.

The circuit arrangement 8 for igniting gas discharge flash tube 10 comprises an HF voltage generator 12, filter capacitor 14 coupled to the anode of the flash tube 10 and via the flash tube 10 to a first terminal 16 of a resonance circuit 18. The resonance circuit 18 comprises an HF capacitor 20 connected in parallel with current limiting inductor 22, having at least two terminals 16 and 24, and an HF inductor 26 coupled between a first input terminal 28 of the resonance circuit 18 and an output terminal 16 or to an additional terminal 24 of the current limiting inductor 22. The output terminals of the HF generator 12 are connected to the input terminals 28, 32 of resonance circuit 18.

In accordance with the present invention, resonance circuit 18 includes the low permeability inductors 22, 26 connected in parallel with a high frequency capacitor 20, which, at the operating frequency of generator 12, provides capacitance reactance to the flash tube 10 and inductance reactance to the output of the high frequency voltage generator 12.

A control high frequency signal is fed from generator 12 to the resonant circuit 18, which provides a series of resonant pulses reaching an amplitude of the AC voltage on the cathode of the flash tube 10. Because the filter capacitor 14 has a low impedance for high frequencies, the anode of the flash tube 10 is coupled via the filter capacitor 14 to the common point connecting HF capacitor 20, current limiting inductor 22 and generator 12. A "high frequency" parallel connection of the flash tube 10 to the resonant circuit provides anode-cathode voltage, which voltage increases until breakthrough voltage of the flash tube is achieved.

The ignition process reduces impedance of the flash tube and provides total parallel connection of the filter capacitor 14 to the HF capacitor 20. The resonant frequency of the network 18 is decreased, such that the difference between the generator's frequency and the soft resonant frequency of the circuit 18 becomes so great, that the HF voltage on the anode-cathode of the flash tube 10 is dramatically reduced. However, energy fed to the flash tube by the high frequency generator 12 must be at the level providing quasi-adiabatic heating of the plasma filament.

Figure 2:
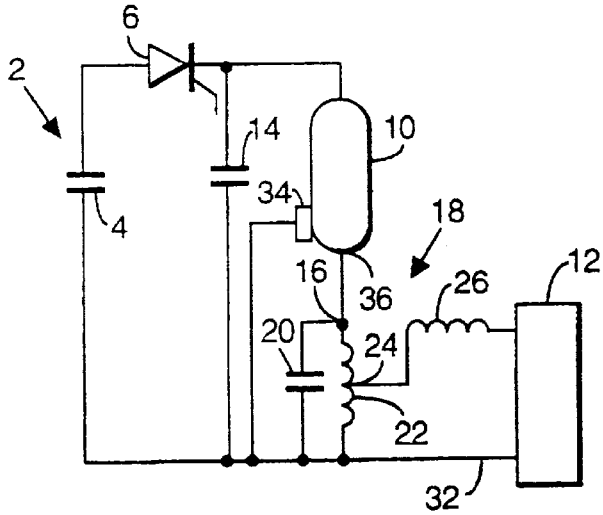

FIG. 2 shows a circuit diagram of an alternative embodiment of the circuit arrangement 8 for igniting gas discharge flash tube 10, wherein flash tube 10 has an additional outside electrode 34 which is located at a small distance from the cathode terminal 36 of the flash tube and is connected to resonant circuit 18. This connection provides a decreased level of the flash tube breakthrough voltage, because around the cathode at the flash tube 10 there is formed a high frequency electrical field producing a quasi cathode (electrical space charge) with high possibility for emission. The spacing of the quasi cathode from the cathode depends on the voltage between the cathode and the additional electrode 34 and on the energy which the plasma filament returns to the environment.

In accordance with the present invention, the circuit of FIG. 2 provides an electrical connection between the cathode of tube 10 and an additional electrode 34 for both AC and DC current. The remainder of the circuit is identical to that described above with reference to FIG. 1.

Figure 3:
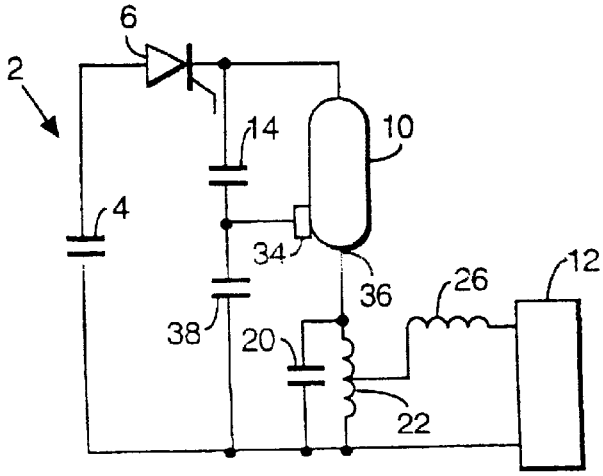

FIG. 3 shows a circuit diagram of an alternative embodiment of the circuit arrangement 8 for igniting gas discharge flash tube 10 shown in FIG. 1, wherein the flash tube 10 has an additional outside electrode 34 which is located at a small distance from the cathode terminal of the flash tube 10 and is connected to the second terminal of the filter capacitor 14 and the first terminal of an additional filter capacitor 38, which second terminal is connected to the terminal 32 of the resonant circuit 18.

Figure 4:
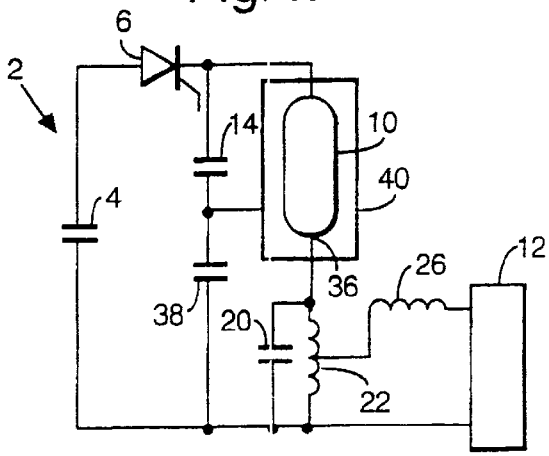

Referring to FIG. 4, there is shown a circuit diagram of a further embodiment of the circuit arrangement for igniting a gas discharge flash tube 10 shown in FIG. 3, wherein the flash tube 10 is located in a conduction cavity 40 which is connected to the second terminal of the filter capacitor 14 and to the first terminal of the additional filter capacitor 38. The second terminal is connected to the terminal 32 of resonant circuit 18. The remainder of the circuit is identical to that described above with reference to FIG. 3.

Figure 5:
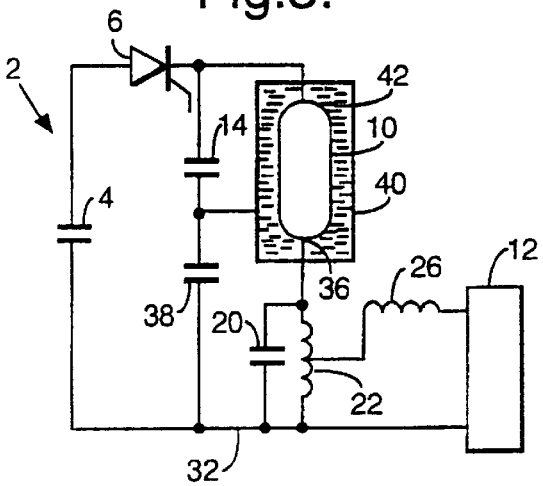

FIG. 5 shows a circuit diagram for an alternative configuration of the circuit arrangement for the ignition gas discharge flash tube 10 shown in FIG. 4, wherein the flash tube 10 is located within a cooling liquid 42 inside the conduction cavity 40. The latter is connected to the second terminal of the filter capacitor and the first terminal of the additional filter capacitor 14, which second terminal is also connected to terminal 32 of resonant circuit 18. The cooling liquid is provided for the operating frequency of generator 12, but it does not change the ignition process.

Figure 6:
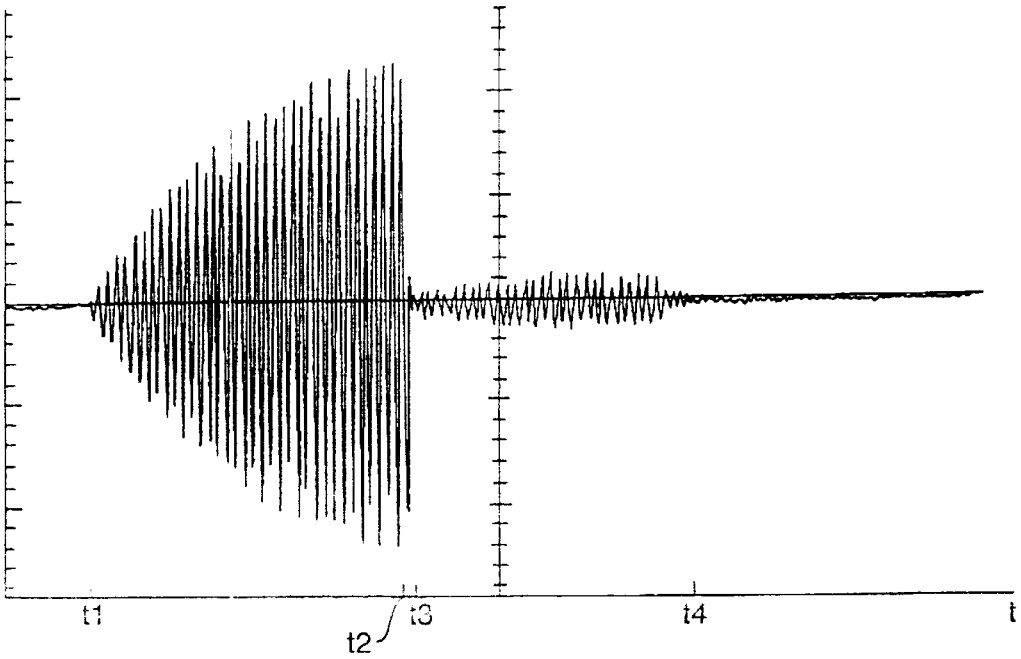

In FIG. 6, there are illustrated the actual results obtained by using various experimental voltage wave forms relating to two periods of time during the operation of the circuits shown in FIGS. 1–5. The intervals (t1–t2) and (t3–t4) illustrate the ignition and simmer modes, respectively.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A circuit arrangement for igniting gas discharge flash tubes including a gas discharge flash tube having two spaced-apart electrodes, a pulse forming network and a voltage generator for supplying ignition pulses and tube burning pulses during simmer mode, said arrangement comprising:

a resonant circuit connected in circuit between said electrodes and said voltage generator, wherein said voltage generator provides said resonant circuit with AC high frequency voltage for producing gradually increasing amplitudes of an AC voltage until ignition voltage is achieved and for supplying AC voltage of a lower level in comparison to the level of the ignition voltage, for sustaining the burning of said tube during said simmer mode.

2. The circuit arrangement as claimed in claim 1, wherein said pulse forming network is constituted by a flash capacitor connected in series with one electrode of said flash tube via a power switch, and a current limiting inductor connected between the second electrode of said flash tube and said capacitor.

3. The circuit arrangement as claimed in claim 1, wherein said resonant circuit is constituted by a low permeability high frequency inductor connected in parallel with a high frequency capacitor, providing capacitance reactance to the flash tube and induction reactance to the output of said voltage generator.

4. The circuit arrangement as claimed in claim 3, where in said capacitor resonance circuit provides an AC resonance of a frequency lower than the operating frequency of the voltage generator and said inductor provides an AC voltage of a frequency equal to the operating frequency of the voltage generator.

5. The circuit arrangement as claimed in claim 3, wherein said limiting inductor is provided with an additional terminal electrically coupled to said high frequency inductor.

6. The circuit arrangement as claimed in claim 3, further comprising a first filter capacitor connected between one electrode of said flash tube and the connection juncture between said limiting inductor and said high frequency capacitor.

7. The circuit arrangement as claimed in claim 6, further comprising a second filter capacitor connected between said first filter capacitor and the common connection juncture of said flash capacitor, said resonant circuit and said voltage generator.

8. The circuit arrangement as claimed in claim 7, wherein said flash tube is located inside a conductive cavity electrically connected to the common connection juncture of said first filter capacitor and said second filter capacitor.

9. The circuit arrangement as claimed in claim 1, wherein said flash tube further comprises a third electrode disposed outside said tube adjacent to the electrode constituting the cathode during operation, said third electrode being connected to the common connection juncture of said flash capacitor, said resonant circuit and said voltage generator.

10. The circuit arrangement as claimed in claim 9, wherein said third electrode is connected to the common connection juncture of said first filter capacitor and said second filter capacitor.

11. The circuit arrangement as claimed in claim 1, wherein said flash tube is located inside a cavity containing cooling liquid.

* * * * *